US005778600A

United States Patent [19]

Chu

[11] Patent Number: 5,778,600

[45] Date of Patent: Jul. 14, 1998

[54] CABLE-TENSIONING DEVICE

[75] Inventor: Yi-Hwa Chu, Ouzouer-sur-Loire, France

[73] Assignee: Meritor Light Vehicle Systems-France, France

[21] Appl. No.: 635,349

[22] Filed: Apr. 19, 1996

[51] Int. Cl.[6] ..... E05F 11/48

[52] U.S. Cl. ..... 49/352; 49/349

[58] Field of Search ..... 49/352, 348, 349

[56] References Cited

U.S. PATENT DOCUMENTS

| | | | |
|---|---|---|---|
| 1,974,342 | 9/1934 | Morris | 267/155 |
| 3,926,066 | 12/1975 | Ladd et al. | 49/349 |
| 4,263,748 | 4/1981 | Kazewych | 49/352 |
| 4,644,695 | 2/1987 | Shiraishi et al. | 49/352 |
| 5,058,332 | 10/1991 | Sambor | 49/348 |
| 5,564,230 | 10/1996 | Periou | 49/349 |

FOREIGN PATENT DOCUMENTS

| | | | |
|---|---|---|---|
| 2441010 | 3/1975 | Germany | 49/351 |
| 2750904 | 5/1979 | Germany | 49/352 |
| 2217784 | 10/1979 | Germany | 49/352 |
| AU9400340 | 1/1995 | WIPO . | |

*Primary Examiner*—Blair Johnson
*Assistant Examiner*—Curtis Cohen

[57] ABSTRACT

The invention relates to a cable-tensioning device associated with a rail (3) having at its ends (4, 5) two points for returning at least one cable (8), characterized in that one (4) of the said ends of the rail includes: a rotary cam (12); a cam-support element (7); a spring (13) coaxial with the cam (12) and having two angularly offset radial tabs (32, 33), a first tab (33) bearing on a stop (19) formed on the support element (7), and the second tab (32) extending inside the cam (12) and being designed to slide over a non-return means (20) arranged on the support element (7) after the cam has rotated through a first travel, this non-return means being shaped to prevent any return of the second tab (32) after the tabs of the spring (13) have become angularly separated by at least the length of the arc between the non-return means (20) and the stop (19), the cable (8) being engaged in grooves (30, 31) formed at the periphery of the cam. This invention has application to motor vehicle door window lifters.

9 Claims, 3 Drawing Sheets

CABLE-TENSIONING DEVICE

BACKGROUND OF THE INVENTION

The subject of the present invention is a cable-tensioning device comprising a rail having at its ends two points for returning at least one cable. This tensioning device is intended in particular to equip a window lifter for a motor vehicle.

It is known that several types of window lifter currently exist in motor vehicles, including window lifters of the twisted cable type. Now, in these window lifters, correct operation is ensured only if the cable(s) remain(s) taut along its(their) entire length. If such is not the case, this lack of tension in the known systems affects the angular play at the window-lifter crank.

Two solutions have therefore been put forward for solving this problem which is due to the lack of tension in the cables:

A first solution consists in a reversible tensioner which uses a stepped sliding component on which a compression spring is mounted. However, the drawback of this embodiment is that it increases the dead play of the crank because the travel of the sliding component associated with the length of winding cable is reflected in an angle at the handle.

The second solution put forward is an irreversible tensioner including a toothed component over which a spring is slipped. This embodiment does not increase the play of the handle but when the window lifter is tensioned by applying a substantial torque at the crank, an overtension is brought about which gives rise to accelerated wear of the window lifter and to an increase in the torque to be exerted on the crank (or transfer torque) for winding the window up or down.

The object of the invention is to propose a window-lifter device which makes it possible to reduce the play at the crank and to absorb any overtorque exerted thereon without giving rise to an overtension in the cables and which is particularly simple to manufacture, reliable and inexpensive.

To this end, the subject of the invention is a cable-tensioning device comprising a rail having at its ends two points for returning one cable, characterized in that one of the said ends of the rail includes:

a rotary cam;

a cam-support element;

a spring coaxial with the cam and having two angularly offset radial tabs, a first tab bearing on a stop formed on the support element, and the second tab extending inside the cam and being designed to slide over a non-return means arranged on the support element after the cam has rotated through a first travel, this non-return means being shaped to prevent any return of the second tab after the tabs of the spring have become angularly separated by at least the length of the arc between the non-return means and the stop, the cable being engaged in grooves formed at the periphery of the cam so that the cam is in equilibrium under the action of opposing forces exerted by the cable and the spring on the cam.

The device according to the invention may include one or more of the following features:

the cam comprises a radial arm extending out from the pivot pin of the cam and in which a radial slot is made for accommodating the second tab of the spring;

the cam has a groove coaxial with the pivot pin and intended to house the spring;

the non-return means is a ramp inclined to the surface of the support element in the direction allowing the second tab of the spring to slide over this ramp when this second tab is angularly separated from the first one;

the radial arm of the cam includes a housing for the non-return means;

the two tabs of the spring are, when at rest, offset by an angle of approximately 90° for example.

the cam has a body extended by a radial arm and on which there is formed a groove delimited by a tab and designed to accommodate a protuberance of the support element, and a groove is arranged on the periphery of the body to accommodate the edge of an opening made in the said cam-support element at the same time as the said protuberance is inserted in the groove; and the end of the second tab of the spring is curved so that it does not damage any corrosion-proof coating on the support element.

Another subject of the invention is a window lifter equipped with a cable-tensioning device as defined hereinabove.

BRIEF DESCRIPTION OF THE DRAWINGS

A non-limiting embodiment of the invention will now be described with reference to the attached drawings, in which.

DETAILED DESCRIPTION OF THE PREFERRED EMBODIMENT

Figure 1:
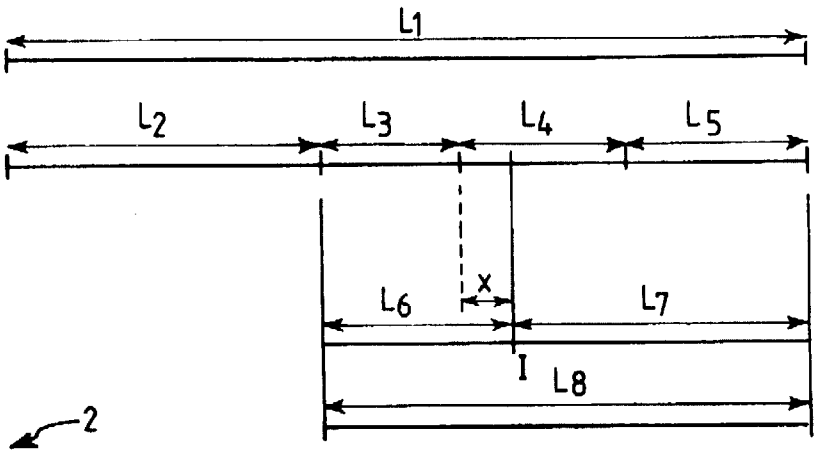
FIG. 1 is a graph showing the principle of the invention.

FIG. 1 shows the operating principle of a cable-tensioning device 1 equipping a window lifter 2 (FIG. 2) intended for a door (not represented) of a motor vehicle.

The device 1 comprises a cable 8 (a single one or one consisting of two portions joined together in a way known per se) of which the overall length (L1) at the end of its service life is the sum of:

the theoretical length L2 of the cable;

the length L3 used for assembling the cable 8 allowing it to be engaged in the members of the window lifter 2;

the length L4, which is the sum of the spread in assembling the window lifter; and the length L5, which is the sum of the extension of the cable 8 and of the length associated with the wear on the members of the window lifter throughout the service life of the window lifter 2.

The length of cable to be managed by the cable-tensioning device 1 is the difference between the length L1 of the cable at the end of its service life and the theoretical length L2 of the cable, that is to say equal to the sum of the values (L3, L4, L5) mentioned hereinabove.

Figure 2:
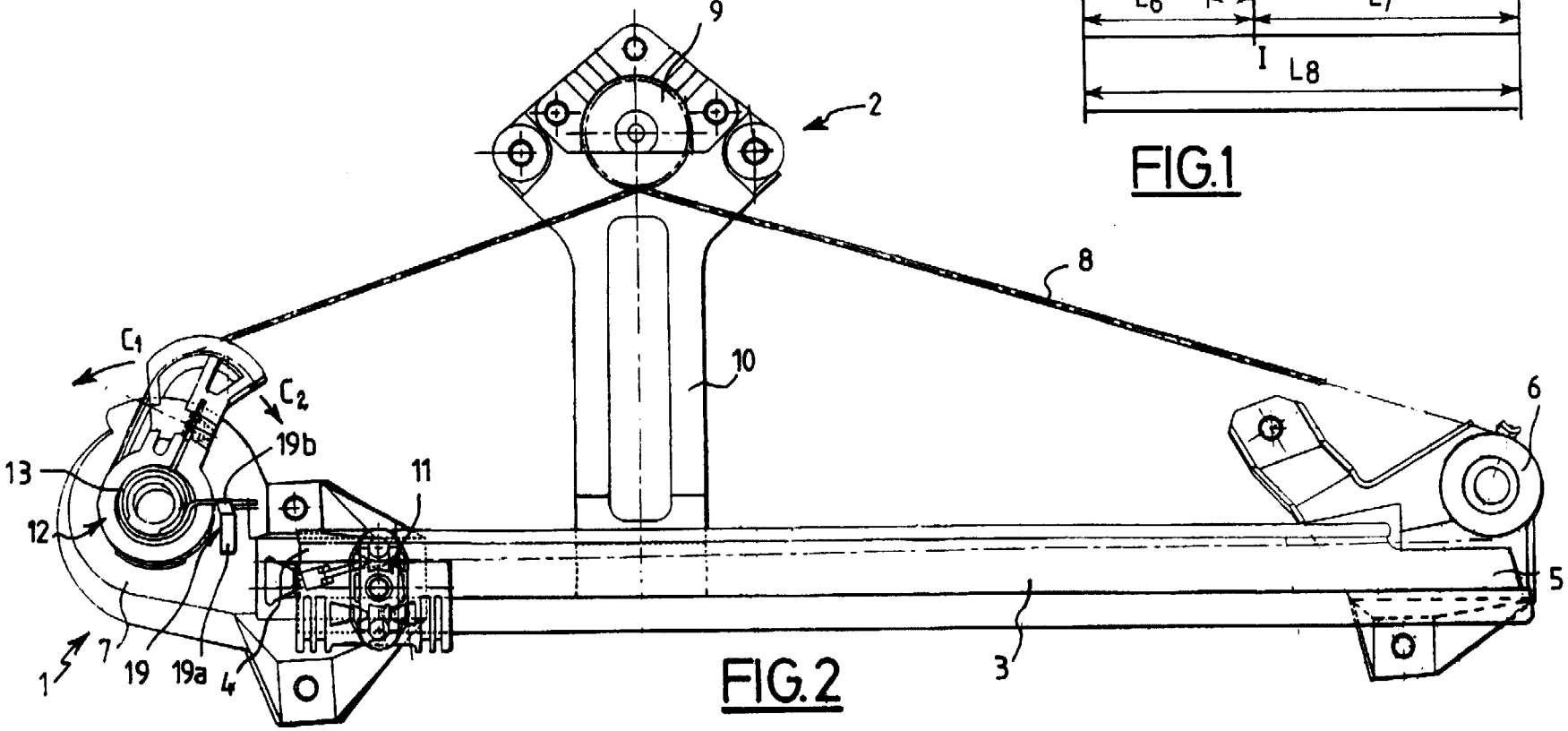
FIG. 2 is a view from above of one embodiment of the cable-tensioning device according to the invention, incorporated into a window-lifter mechanism.

In order to achieve the objectives of the present invention, a point I called the position of irreversibility is defined, this point being situated as FIG. 2 shows in the range of the length L4, the sum of the assembly spread. This point I corresponds to the sum of the assembly length L3 of the cable 8 and of x, where x is a length defined as follows:

a) if the spread corresponds to x (L4=x), then there is no impact on the window transfer torque at the crank, b) if the spread is less than x (L4<x), this leads to an overtension which has little or no influence on the window transfer torque at the crank, c) if the spread is greater than x (L4>x), the value of x converted into an angle at the axis of the crank will no longer be apparent when measuring the free play at the crank and will have no impact on the operating cable.

This point I thus defines two modes of operation of the cable-tensioning device 1; a mode known as irreversible in which the device 1 has definitively absorbed the assembly length L3 of the cable and the value of x, and a mode known as reversible in which the device 1 within the reversible range (L5+L4−x) flexibly adapts to any residual assembly spread, to variations in length of the cable throughout its use, and to wear of the components of the window lifter in contact with the cable 8.

The tensioner has therefore to be irreversible in a first instance after the window lifter is operated (the cable 8 passing from a non-taut state into a taut state) then has to become reversible, and this is why it constitutes a mixed tension system.

The window lifter 2 represented in FIG. 2 comprises a rail 3 having two ends 4 and 5 which bear respectively a return pulley 6 and a support element 7 housing a cam 12 and a spring 13, the rail being intended to be fixed to a door (not represented) of a motor vehicle via its fixing tabs. The device 1 also comprises a twisted cable 8 engaged in the pulley 6, in two grooves 30, 31 of the cam 12 and in a system 9 for driving the window lifter 2.

This drive system 9 is borne by a mounting plate 10 fixed to the rail 3, transverse to the rail 3 in the example represented.

That part of the cable 8 which extends between the two ends 4 and 5 of the rail 3 drives a slide 11, known per se, guided by this rail and on which a window pane (not represented) which can move "vertically" is mounted (the rail 3 being arranged "vertically").

Figure 5:
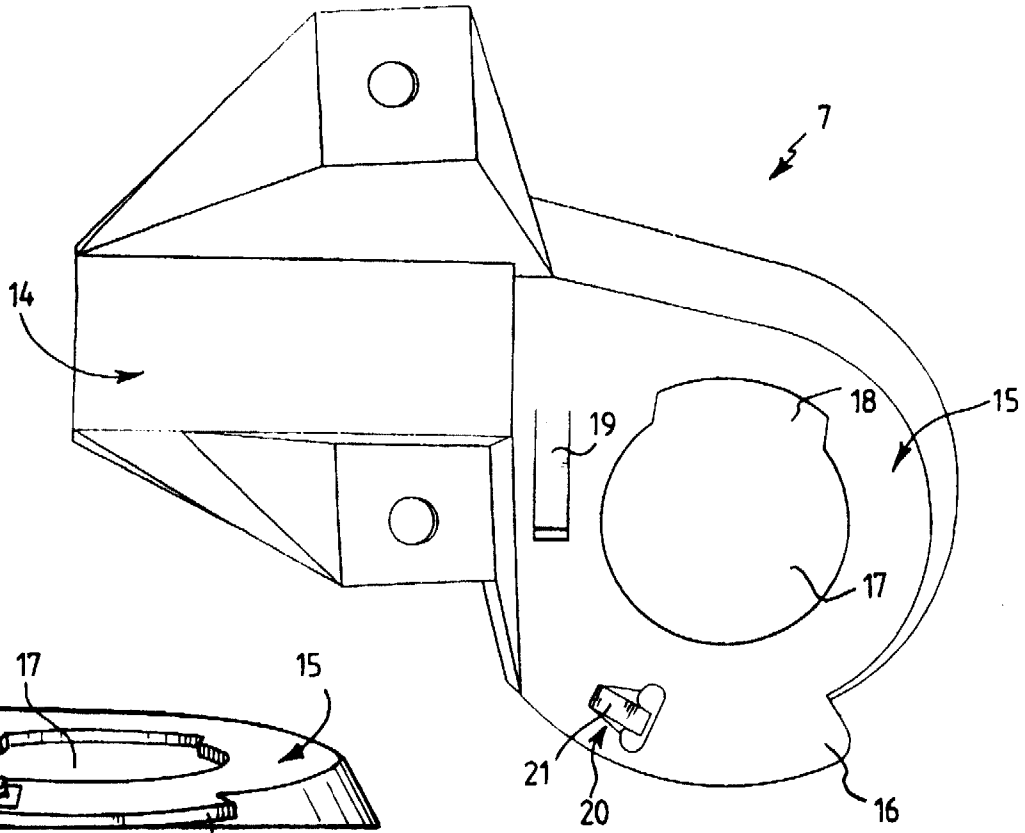
FIG. 5 is a view from above on an enlarged scale of the support for the cam of FIGS. 3 and 4.
Figure 6:
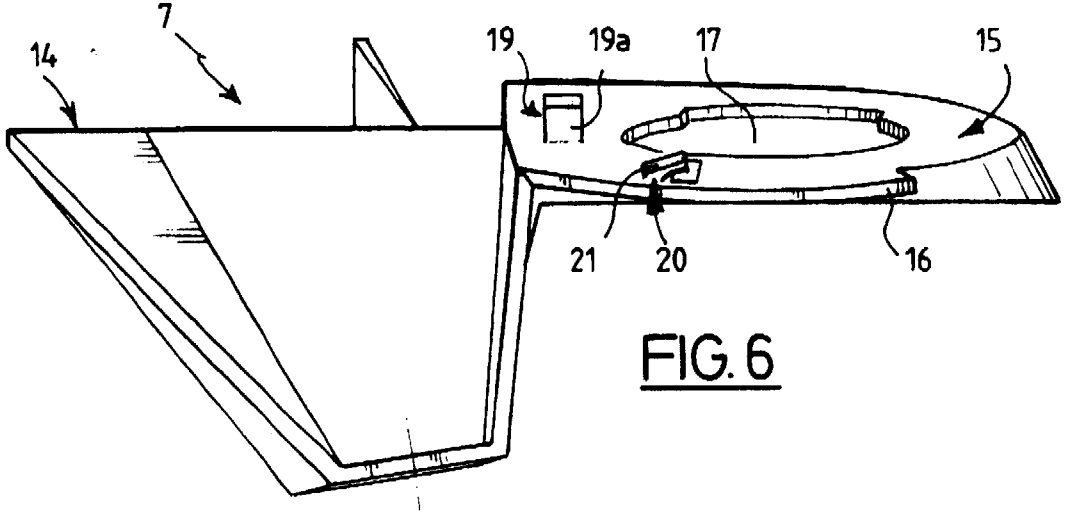
FIG. 6 is a side elevation of the cam support.

The support element 7 represented in FIGS. 5 and 6 is composed of a part 14 making it possible to fix it to the rail 3 and of a plate 15 intended to house the cam 12. This element 7 may be made of steel for example.

The plate 15 has a protuberance 16 extending over part of its periphery. An opening 17 is made at the centre of this plate. This opening 17 is of circular shape with a part 18 in the shape of an arc of a circle having a radius greater than that of the rest of the opening, this part being situated on the opposite side to the protuberance 16.

A spring stop 19 is fixed to the plate 15 close to the junction between the plate 15 and the fixing part 14. This stop 19 has the shape of an angle bracket having one tab 19*a* fixed to the plate 15, the end of the other tab 19*b*, which is shorter, being slightly curved.

Figure 7:
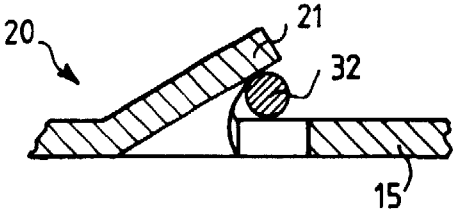
FIG. 7 is a part section on an enlarged scale of the cam support non-return means.

The protuberance 16 has an integrally-formed non-return ramp 20. As represented in FIG. 7, this ramp 20 has an inclined part 21 forming an appropriate angle, for example 30° with the plate 15. This ramp 20 is inclined in the same direction as the stop 19.

Figure 3:
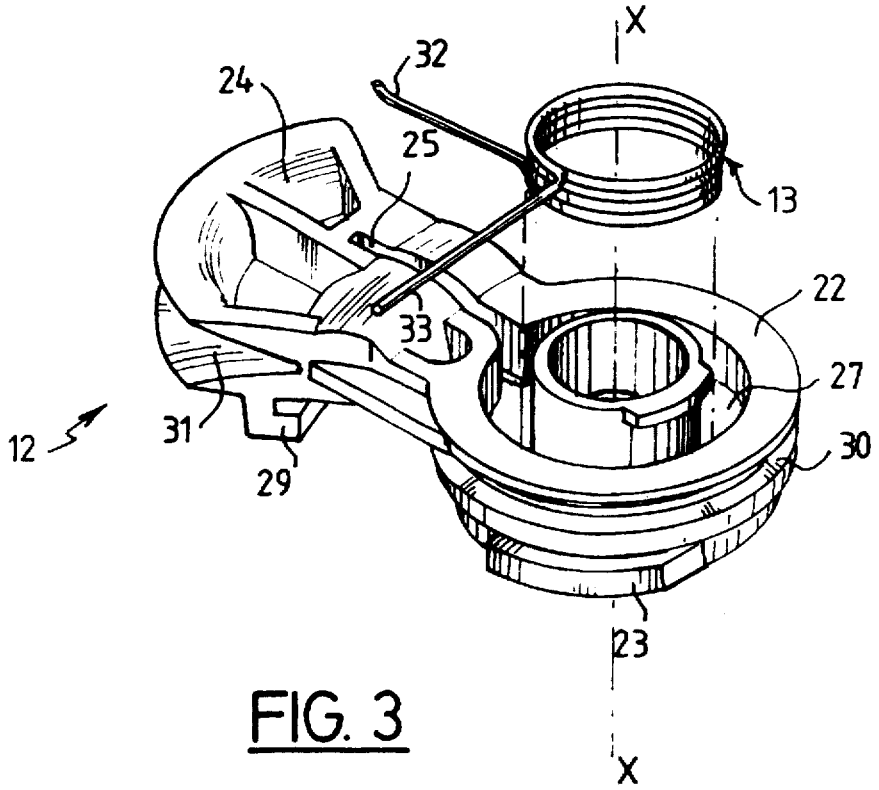
FIG. 3 is a perspective view from above on an enlarged scale, of the cam of the tensioning device of FIG. 1.
Figure 4:
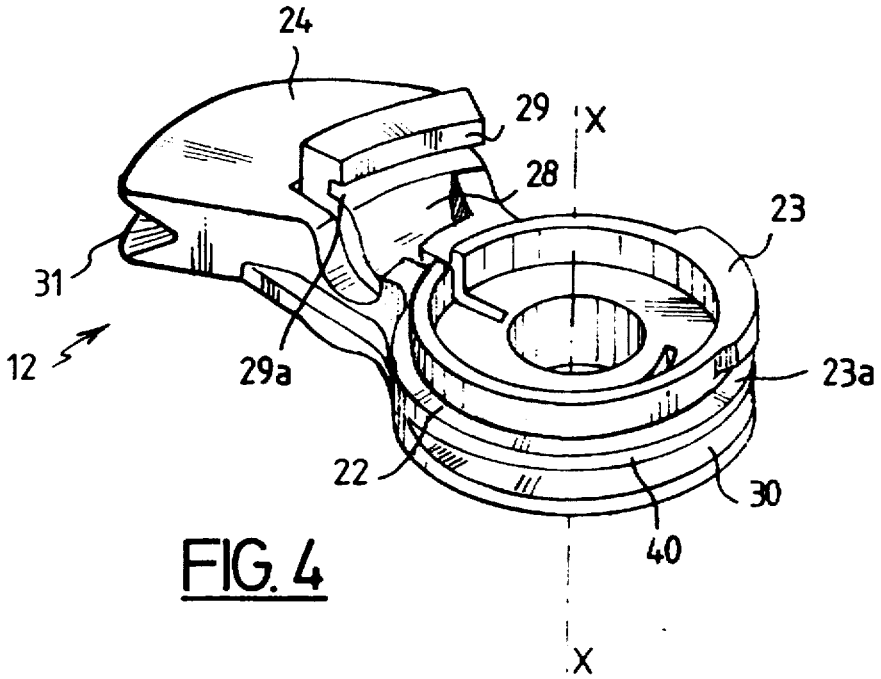
FIG. 4 is a perspective view from below of the cam of FIG. 3.

The cam 12 and the spring 13 are described with reference to FIGS. 3 and 4. The cam 12 has a cylindrical body 22 of axis X—X, the outside diameter of which is equal to the smallest diameter of the opening 17. The lower part of this body 22 bears a tongue 23 projecting outwards to take up the forces applied to the cam when transferring the window pane and to hold it in position, this tongue having a shape which complements that of the part 18 of the opening 17.

Together with a projecting peripheral collar 40 of the body 22, the tongue 23 delimits a groove 23*a*.

The cam 12 has a radial arm 24 which extends out from the body 22. The end of this arm has the shape of an arc of a circle. Inside the arm there extends a radial slot 25 which emerges in a circular groove 27 formed in the body 22 and is intended to house the torsion spring 13. Formed in a lower part of the radial arm 24 is a housing 28 in the shape of an arc of a circle, the depth of which is greater than the height of the ramp 20, and likewise its width.

Arranged close to the housing 28 is a tab 29 having a cross-section in the shape of an angle bracket oriented in the direction of the axis X—X and delimiting an opening or groove 29*a*. Formed in the circular body 22 and in the end of the radial arm 24 respectively are grooves 30 and 31 intended to accommodate the cable 8.

The torsion spring 13 is equipped with two radial tabs 32 and 33 which are offset from one another by 90° for example. When this spring is fitted in the groove 27, the tab 32 is inserted in the slot 25. This same tab 32 is curved at its end (FIG. 3) so as to reduce the aggression of this end on a corrosion-proof coating of the support 7 during movements of the cam.

The cam 12 is mounted on the support element 7 by inserting the tongue 23 in the part 18 of the plate 15 then by pivoting the protuberance 16 into the opening 29*a* of the tab 29. This allows the cam to be rotated through a small angle about the axis XX.

The cable 8 is fitted into the grooves 30 and 31 of the cam 12. The cable is then tensioned by pivoting the cam 12, compressing the spring 13. Tension is maintained by placing the tab 33 behind the stop 19.

The tab 32 of the spring 13 has therefore slid over the inclined part 21 of the ramp 20, becoming embedded in the housing 28. Then, after having ridden over it, the tab 32 takes a purchase under this inclined part 21 (FIG. 7). The device is then in its "reversibility range" in which the cam 12 is in equilibrium under the action of the opposing torques C1 and C2 exerted respectively on it by the spring 13 and by the cable 8.

As the spring 13 tends to push the cam 12 back towards the outside of the device 1, the cable 8 is always under tension, even after the mechanism has worn a little. By contrast, an overtorque exerted on the cable 8 will be absorbed by the cam moving towards the inside of the device 1, the rotational travel of the cam being limited by the tab 32 butting up against the non-return ramp 20.

I claim:

1. A cable tensioning device for a window lifter mechanism, said cable tensioner associated with a rail having first and second ends, wherein said first rail end has a first cable return and wherein said second rail end has a second cable return, and wherein a cable is alternately reciprocally returned by said first and second cable returns, wherein said first rail end includes:

a rotary cam having an interior and an exterior, said cam further having grooves formed about its periphery;

a cam-support element having a stop formed thereon and also having a non-return means shaped thereon, said stop and said non-return means are radially disposed from one another by an arc of fixed length; and a spring coaxial with said cam, said spring having a first axially offset radial tab bearing on said cam-support element stop, and a second axially offset radial tab extending inside said rotary cam, said second tab adapted to slide over said non-return means after the cam has rotated through a first travel, said non-return means shaped to prevent any return of said second tab back over said non-return means after said first and second tabs have become angularly separated by at least the length of said arc between said non-return means and said stop, said cable engaged in said grooves, wherein said cam is in equilibrium under the action of opposing forces exerted by said cable and said spring wherein said cam support element has a cam support upper surface and wherein said non-return means is a ramp inclined toward said cam support upper surface, wherein when said second tab is angularly separated from said first tab, said second tab slides rampingly upward along said inclined ramp.

2. A device according to claim 1, wherein said cam comprises a radial arm extending out from a cylindrical body, wherein a radial slot is formed therein said radial arm, said radial slot adapted to receive therein said second angularly offset radial extending tab of said spring.

3. A device according to claim 2, wherein said cam further has a groove coaxial with said pivot pin, said groove adapted to house said spring.

4. A device according to claim 2, wherein said radial arm includes a housing for said non-return means.

5. A device according to claim 1, wherein said first and second tabs are, when at rest, offset by an angle of approximately 90°.

6. A device according to claim 1, wherein said cam has a body, said cam body having a radial arm extending therefrom, said radial arm having formed thereon a groove, said groove delimited by a tab, said groove tab designed to accommodate a protuberance of said cam support element, wherein said radial arm further has a key way formed on the periphery of said cam body, said key way adapted to accommodate a key formed on said cam support element when said protuberance is inserted in the groove.

7. A device according to claim 1 wherein said second tab has an end which is curved so that it does not damage said support element.

8. A device according to claim 1 wherein said ramp is integrally formed with said cam.

9. A device according to claim 8 wherein said ramp is inclined approximately thirty degrees relative to said cam support upper surface.

* * * * *